United States Patent [19]

Deasy

[11] Patent Number: 4,511,900

[45] Date of Patent: Apr. 16, 1985

[54] CURRENT ENHANCED MONOPOLE RADIATION TYPE ANTENNA APPARATUS

[75] Inventor: Richard E. Deasy, Cedar Rapids, Iowa

[73] Assignee: Rockwell International Corporation, El Segundo, Calif.

[21] Appl. No.: 376,871

[22] Filed: May 10, 1982

[51] Int. Cl.[3] ..... H01Q 9/38

[52] U.S. Cl. ..... 343/845; 343/841; 343/851

[58] Field of Search ..... 343/845, 847, 848, 850, 343/851, 741, 790, 791, 803, 841, 745, 748, 860, 866

[56] References Cited

U.S. PATENT DOCUMENTS

| | | | |
|---|---|---|---|
| 2,615,134 | 10/1952 | Carter | 343/845 |
| 2,617,028 | 11/1952 | Stolk | 343/791 |
| 2,647,211 | 7/1953 | Smeby | 343/841 |
| 2,666,850 | 1/1954 | Kraus | 343/790 |
| 2,702,345 | 2/1955 | Walter | 343/845 |
| 2,994,876 | 8/1961 | Josephson | 343/848 |
| 3,289,208 | 11/1966 | Hollingsworth | 343/845 |
| 3,380,060 | 4/1968 | Czerwinski | 343/845 |
| 3,761,940 | 9/1973 | Hollingsworth | 343/830 |

*Primary Examiner*—Eli Lieberman
*Assistant Examiner*—Karl Ohralik
*Attorney, Agent, or Firm*—George A. Montanye; Bruce C. Lutz; H. Fredrick Hamann

[57] ABSTRACT

A high current low impedance antenna having an electrically short monopole radiation pattern is provided by shielding at least one of the segments or legs of a loop antenna so that the shielded leg has no cancelation effects and thereby produces the uniform radiation pattern of a short monopole antenna.

8 Claims, 3 Drawing Figures

CURRENT ENHANCED MONOPOLE RADIATION TYPE ANTENNA APPARATUS

The present invention is generally concerned with electronics and more specifically with antennas. Even more specificially, the present invention is concerned with an electrically short monopole type radiation pattern which does not require high voltages to obtain relatively large signal currents.

When it is desired that an antenna have an omnidirectional low angle radiation pattern, many systems use a short monopole antenna. Relatively large voltages are required to produce current flow in the conventional monopole type of antenna because of the characteristically high driving point impedance. The high voltage may be reduced by the use of capacitive top loading. Conventional top loading lowers antenna impedance and increases current but produces an ungainly antenna for many purposes such as when used on a vehicle. Since high voltages also create problems in generation, shielding and insulation, it is desirable that a monopole radiation type antenna be designed which can utilize low voltages and still have a fairly compact design.

It is therefore an object of the present invention to provide an improved monopole radiation type antenna means.

Other objects and advantages of the present invention may be ascertained from a reading of the specification and appended claims in conjunction with the drawings wherein:

DETAILED DESCRIPTION

Figure 1:
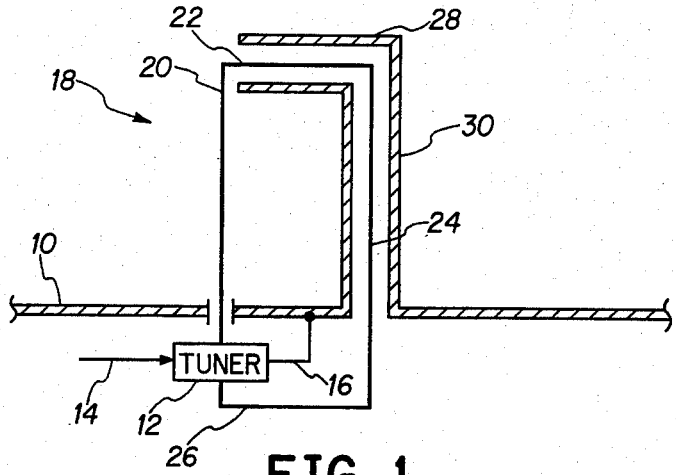
FIG. 1 is a rough representation of a closed loop transmission line antenna means configured in a monopole radiation pattern.

In FIG. 1 a ground plane 10 has a tuner 12 with signal input 14. Tuner 12 is grounded by a lead 16 to the ground plane 10. A closed loop transmission line generally designated as antenna means 18 has a series of segments labeled 20 (first unshielded electrical conductor portion), 22, 24 and 26. In most embodiments of the invention, the segments 20 and 24 will be relatively long as compared to the segments 22 and 26. The segments (second electrical conductor portion) 22, 24 and 26 are enclosed by shielding apparatus so that radiation is not permitted to the environment from these segments. Specifically, segment 26 is shielded by ground plane 10 while segments 22 and 24 are shielded by shielding portions 28 and 30. Portions 28 and 30 may be aluminum tubing or any other adequate shielding apparatus which may be effectively grounded to ground plane 10. Tuner 12 is an impedance matching network used to provide efficient transfer of power between antenna 18 and input signal 14.

Figure 2:
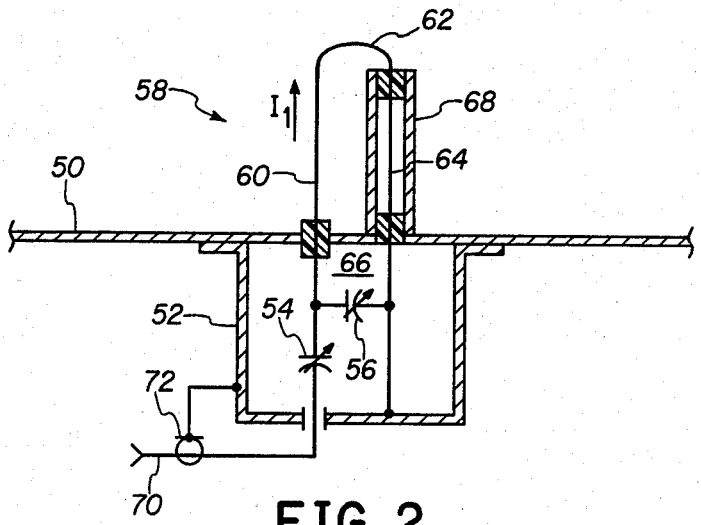
FIG. 2 is a more detailed circuit diagram of a closed loop antenna means in a practical embodiment of a monopole radiation pattern.

FIG. 2 also illustrates a ground plane 50 which has a shielded box 52 attached thereto and containing a tuner made up of capacitors 54 and 56 each of which are tunable or variable in capacitive values. A current $I_1$ is shown transversing the loop or current enhanced monopole structure generally designated as 58 and having segments 60, 62, 64 and 66. Segment 66 is contained within enclosure 52 while segment 64 is contained within a shielding enclosure 68. A coaxial interface is represented by a signal lead 70 and a grounded shield 72. Capacitor 54 is a series phasing capacitor while capacitor 56 is a shunt loading or impedance magnitude changing capacitor.

Figure 3:
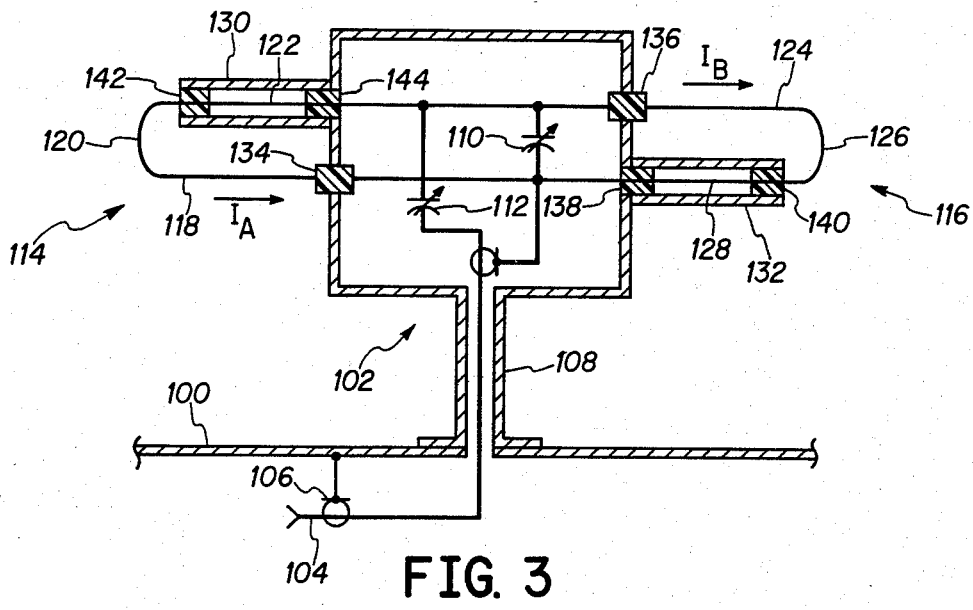
FIG. 3 is a schematic diagram of a configuration of a pair of monopole radiation pattern antenna means configured to form a dipole antenna radiation pattern utilizing the concepts of the present invention.

In FIG. 3 a ground plane 100 is shown with an RF shield enclosure 102. A coaxial cable having a signal conductor 104 and a grounded shield 106 supplies signals from beneath the ground plane 100 through a standoff portion 108 of the RF shield 102 to a centralized portion of enclosure 102. Within the centralized portion of 102 is a loading capacitor 110 and a phasing capacitor 112. Two loop antenna means generally designated as 114 and 116 are arranged to form the elements of a current enhanced dipole antenna. Loop 114 is illustrated having segments 118, 120 and 122 with the remainder of this loop contained within enclosure 102. Monopole antenna 116 comprises elements or segments 124, 126 and 128 outside enclosure 102 with the remaining segment being shared with monopole antenna 114. As illustrated, segment 122 is enclosed by a shield 130 while segment 128 is enclosed by segment 132. The loop conductor is insulated from contact with ground and RF shields by insulators such as 134, 136, 138, 140, 142 and 144.

OPERATION

As indicated previously, the prior art has used a high impedance voltage excited monopole to provide an omnidirectional low angle radiation field pattern. The present invention uses a closed loop transmission line at least half of which is shielded to produce a current excited monopole antenna which produces substantially the same radiation field pattern as provided by the prior art monopole antennas. The shielded portion of the closed loop transmission line acts as a form of inductive loading to the unshielded radiating portion and thus a resonant circuit is created which provides a low impedance path at the resonant frequency to provide the high current desired for efficient signal power radiation.

Referring first to FIG. 1, the tuner 12 is merely an impedance matching interface between the driving circuitry and the antenna. Tuner 12 contains the necessary elements to operate with the antenna system transmission line structure to produce the resonant impedance matched condition to transfer power. The current flowing in this closed loop is allowed to radiate from segment 20 of the closed transmission line but not allowed to radiate from the shielded portions 22, 24 and 26. Thus, the single line or segment 20 produces the total radiation pattern from the antenna. The antenna system is also effective for the reception of radio signals, the only difference being the reversed direction of power flow through the system.

FIG. 2 is a specific implementation of FIG. 1 wherein segment 62 is not shielded since this segment of the closed transmission line is very short and orthogonal to segment 60 so it would not affect the basic monopole radiating pattern provided by segment 60. Segment 62 could be considered as an independent radiating element. Further, the phasing and loading capacitors 54 and 56 respectively, are illustrated as one method of obtaining the resonant condition for the closed loop tranmission line. Thus, enclosure 52 essentially incorporates the contents of tuner 12 in FIG. 1.

FIG. 3 is merely a representation of how two monopole radiating pattern type means of the present invention can be connected to provide dipole antenna operation. Again, the segments 120 and 126 were not shielded as in FIG. 2 since, for many applications of the inventive concept, this segment will not affect dipole radiating signals. The currents $I_A$ and $I_B$ are illustrated merely to show the current flow direction that is necessary to obtain appropriate dipole operation of an additive rather than a cancelative nature.

While the general concept and two specific embodiments have been illustrated for using the closed transmission line as a monopole radiation type antenna means, I do not wish to be limited by the specific embodiment shown but only by the scope of the appended claims wherein I claim.

I claim:

1. A system for generating a monopole radiation pattern comprising:

a ground plane having first and second sides;

an electrically short closed loop antenna including, an input terminal positioned on said first side of said ground plane, a first unshielded electrical conductor portion positioned on said second side of said ground plane and forming an antenna radiating portion, said first unshielded electrical conductor portion including first and second ends, said first end being electrically insulated from and extending through said ground plane and coupled to said input terminal, a second electrical conductor portion positioned on said second side of said ground plane and electrically insulated from said ground plane and having a first end coupled to said second end of said first conductor portion and a second end electrically insulated from and extending through said ground plane, and a return terminal positioned on said first side of said ground plane and coupled to said second end of said second conductor portion; and an electrically conductive non-radiating shield positioned on said second side of said ground plane and surrounding and electrically insulated from said second conductor portion, said electrically conductive shield being electrically connected to said return terminal.

2. A system for generating a monopole radiation pattern comprising:

a ground plane having first and second sides;

an electrically short closed loop antenna including, an input terminal positioned on said first side of said ground plane, a first unshielded electrical conductor portion positioned on said second side of said ground plane and forming an antenna radiating portion, said first unshielded electrical conductor portion including first and second ends, said first end being electrically insulated from and extending through said ground plane and coupled to said input terminal, a second electrical conductor portion positioned on said second side of said ground plane and electrically insulated from said ground plane and having a first end coupled to said second end of said first conductor portion and a second end electrically insulated from and extending through said ground plane, and a return terminal positioned on said first side of said ground plane and coupled to said second end of said second conductor portion; and an electrically conductive non-radiating shield spaced from and surrounding said second conductor portion on said second side of said ground plane and electrically insulated from said second conductor portion, said electrically conductive shield being electrically connected to said return terminal.

3. An antenna system for generating a symmetrical radiation pattern of the type produced by an electrically short monopole antenna comprising:

a ground plane having first and second sides;

an electrically short closed loop antenna including, an input terminal positioned on said first side of said ground plane, a first unshielded electrical conductor portion positioned on said second side of said ground plane and forming an antenna radiating portion, said first unshielded electrical conductor portion including first and second ends, said first end being electrically insulated from and extending through said ground plane and coupled to said input terminal, a second electrical conductor portion positioned on said second side of said ground plane and electrically insulated from said ground plane and having a first end coupled to said second end of said first conductor portion and a second end electrically insulated from and extending through said ground plane, and a return terminal positioned on said first side of said ground plane and coupled to said second end of said second conductor portion; and an electrically conductive non-radiating shield spaced from and surrounding said second conductor portion on said second side of said ground plane and electrically insulated from said second conductor portion, said shield being electrically coupled to said ground plane;

means for providing a signal to be radiated between said input terminal and said return terminal at a selected frequency; and means coupled to impedance match said closed loop antenna for receipt of said signal to be radiated to produce resonance in said closed loop antenna at said frequency to produce a high current for radiation of said signal from said first conductor portion.

4. The system of claim 2 further including means to said first and second conductor portions for producing resonance of said signal in said closed loop antenna which provides a low impedance path at the resonant frequency to produce high current radiation of said received signal from said first conductor portion.

5. The system of claim 2 wherein said means for producing resonance comprises a capacitive tuner.

6. A dipole antenna system comprising:

first and second closed loop antennas, each comprising an input terminal, a first unshielded electrical conductor portion coupled to said input terminal, a second electrical conductor portion coupled to said first conductor portion, and a return terminal coupled to said second conductor portion;

means surrounding said second conductor portion of each of said first and second closed loop antennas for forming an electrically conductive shield about said second conductor portion;

means coupled between said input and return terminals for causing said first and second closed loop antennas to form a resonant circuit which provides a low impedance path at a resonant frequency.

7. The antenna of claim 6 wherein said input terminal of said second antenna is coupled in common with the return terminal of said first antenna to form a first signal input and the input terminal of said second antenna is coupled in common with the return terminal of said first antenna to form a second signal input, each of said means for forming an electrically conductive shield being electrically connected to said first signal input and said first and second antennas being constructed and arranged with respect to one another to form a dipole radiation pattern.

8. The system of claim 7 further including means for providing a signal between said first and second signal inputs at said resonant frequency for radiating said signal from the first conductor portions of said first and second antennas.

* * * * *